US007566224B2

(12) United States Patent
Wu

(10) Patent No.: US 7,566,224 B2
(45) Date of Patent: Jul. 28, 2009

(54) ELECTRICAL CONNECTOR ASSEMBLY WITH MAGNETIC RETENTION DEVICE

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/982,636

(22) Filed: Nov. 2, 2007

(65) Prior Publication Data

US 2009/0117783 A1 May 7, 2009

(51) Int. Cl.
*H01R 11/30* (2006.01)

(52) U.S. Cl. ..... 439/39

(58) Field of Classification Search ..... 439/38–40
See application file for complete search history.

(56) References Cited

U.S. PATENT DOCUMENTS

| | | | | |
|---|---|---|---|---|
| 3,144,527 | A * | 8/1964 | Tolegian | 439/38 |
| 3,808,577 | A * | 4/1974 | Mathauser | 439/39 |
| 3,972,208 | A * | 8/1976 | Ferrington | 66/219 |
| 4,500,881 | A * | 2/1985 | Beane | 439/38 |
| 5,921,783 | A * | 7/1999 | Fritsch et al. | 439/38 |
| 5,954,520 | A * | 9/1999 | Schmidt | 439/39 |
| 6,568,942 | B2 * | 5/2003 | Lau et al. | 439/39 |
| 6,623,276 | B2 * | 9/2003 | Dalmau Ferrerfabrega et al. | 439/39 |
| 6,749,467 | B2 * | 6/2004 | Korsunsky et al. | 439/38 |
| 7,204,695 | B1 * | 4/2007 | Shiu et al. | 439/38 |
| 7,217,142 | B1 | 5/2007 | Wu | |
| 7,247,046 | B1 | 7/2007 | Wu | |
| 7,329,128 | B1 * | 2/2008 | Awad et al. | 439/38 |
| 2001/0031565 | A1 * | 10/2001 | Sakiyama | 439/38 |
| 2007/0072443 | A1 | 3/2007 | Rohrbach et al. | |

* cited by examiner

*Primary Examiner*—Briggitte R Hammond
(74) *Attorney, Agent, or Firm*—Wei Te Chung

(57) ABSTRACT

An electrical connector assembly (100) comprising a plug connector (1) and a receptacle connector (2). The plug connector (1) comprises an insulated housing (13) defining a number of vertical mounting grooves (1311); a number of terminals (12) received in the insulated housing, said each of the terminals having a vertical contact portion arranged in corresponding vertical mounting groove; an attraction member (11) assembled to the insulated housing (13). The receptacle connector (2) comprises an insulative housing (23) defining a number of passageways (232) along front-to-back direction; a number of spring contacts (24) respectively received in the passageways; a magnetic block (22) assembled to the insulative housing. The plug connector and the receptacle connector are securely coupled together via a magnetic attraction between the magnetic member and the attraction member thereof. The spring contacts of the receptacle connector contact the terminals of the plug connector, respectively.

15 Claims, 10 Drawing Sheets

2

2

ELECTRICAL CONNECTOR ASSEMBLY WITH MAGNETIC RETENTION DEVICE

CROSS-REFERENCE TO RELATED APPLICATION

This application is related to U.S. Pat. No. 7,217,142 B2 issued on May 15, 2007 and entitled "CABLE CONNECTOR ASSEMBLY WITH IMPROVED CONTACTS", and it has the same applicant and assignee as the present invention. The disclosure of the related application is incorporated herein by reference.

BACKGROUND OF THE INVENTION

1. Field of the Invention

The present invention generally relates to an electrical connector assembly, and more particularly to an electrical connector assembly using magnetic attraction as retention means.

2. Description of Related Art

An electrical connector is an important I/O which is widely applied in signal transmission or power delivery. In order to prevent mated electrical connectors being separated away from each other when they are in working status, a mechanism latch device is used to retain them together. However, the latch device may deformed if it is improperly used or some other reasons, thus the latch device couldn't ensure that the mated electrical connectors are coupled together securely.

Hence, an improved electrical connector assembly is highly desired to overcome the disadvantages of the related art.

SUMMARY OF THE INVENTION

Accordingly, an object of the present invention is to provide an electrical connector assembly using a magnetic device as retention means.

In order to achieve the object set forth, an electrical connector assembly in accordance with the present invention comprises an electrical connector assembly comprising a plug connector and a receptacle connector. The plug connector comprises an insulated housing defining a number of vertical mounting grooves; a number of terminals received in the insulated housing, said each of the terminals having a vertical contact portion arranged in corresponding vertical mounting groove; an attraction member assembled to the insulated housing. The receptacle connector comprises an insulative housing defining a number of passageways along front-to-back direction; a number of pogo type terminals respectively received in the passageways, said each of the terminals having a mating segment forwardly extending out of the passageway; a magnetic block assembled to the insulative housing. The plug connector and the receptacle connector are securely coupled together via a magnetic attraction between the magnetic member and the attraction member thereof. The spring contacts of the receptacle connector contact the terminals of the plug connector, respectively.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
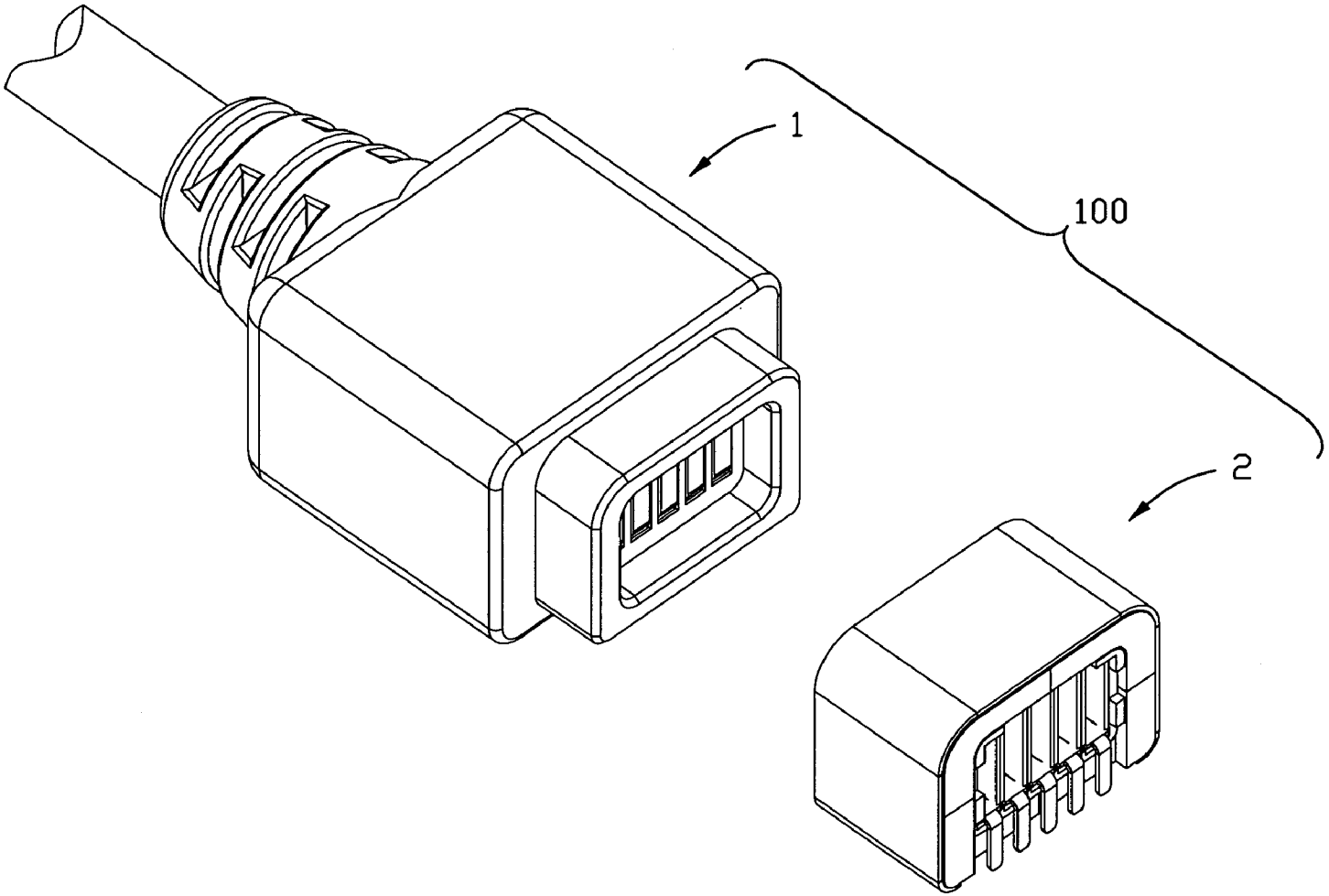
FIG. 1 is an electrical connector assembly including a plug connector and a receptacle connector in accordance with the present invention.
Figure 2:
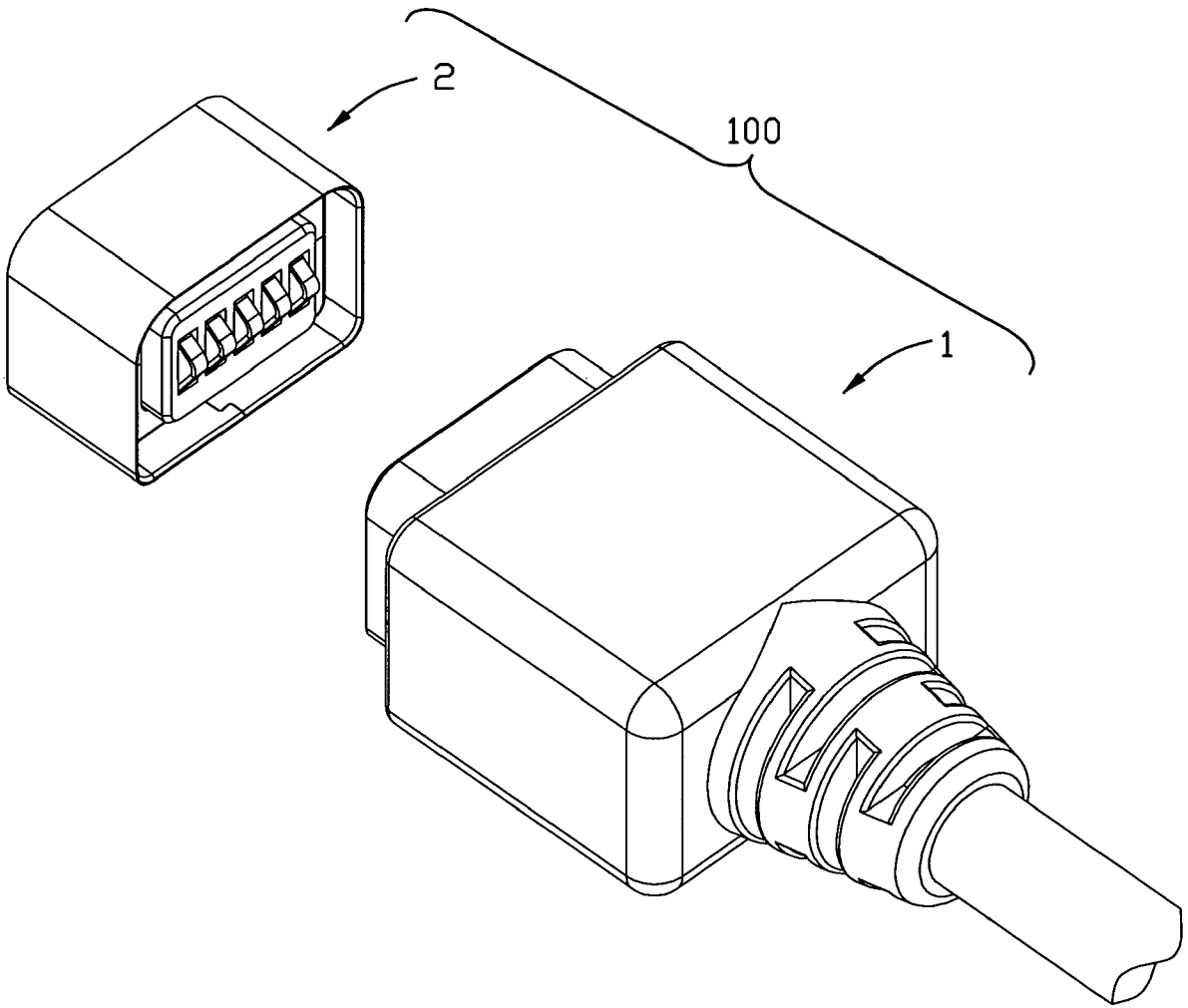
FIG. 2 is a view similar to FIG. 1, but viewed from another aspect.
Figure 3:
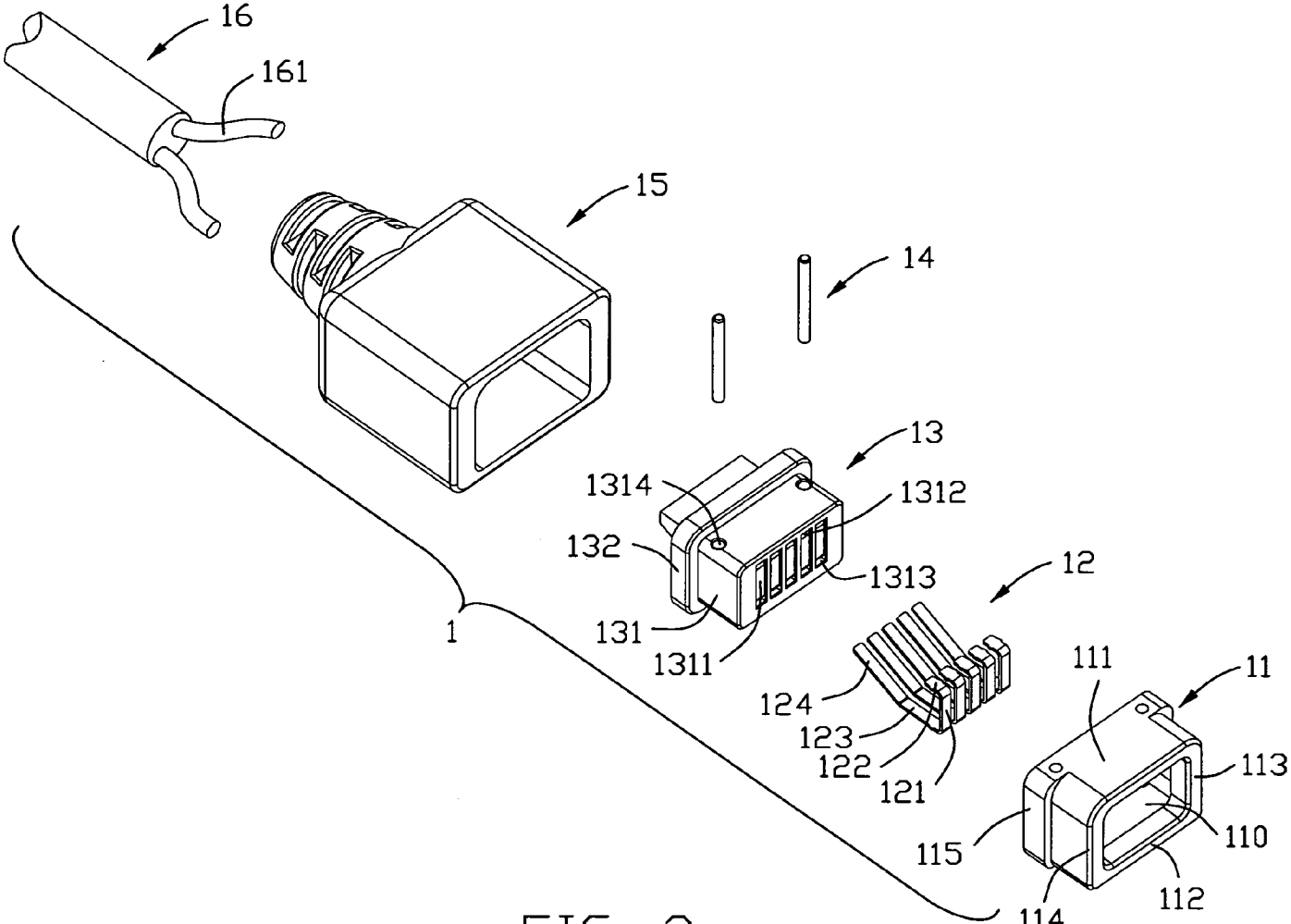
FIG. 3 is an exploded, perspective view of the plug connector.
Figure 4:
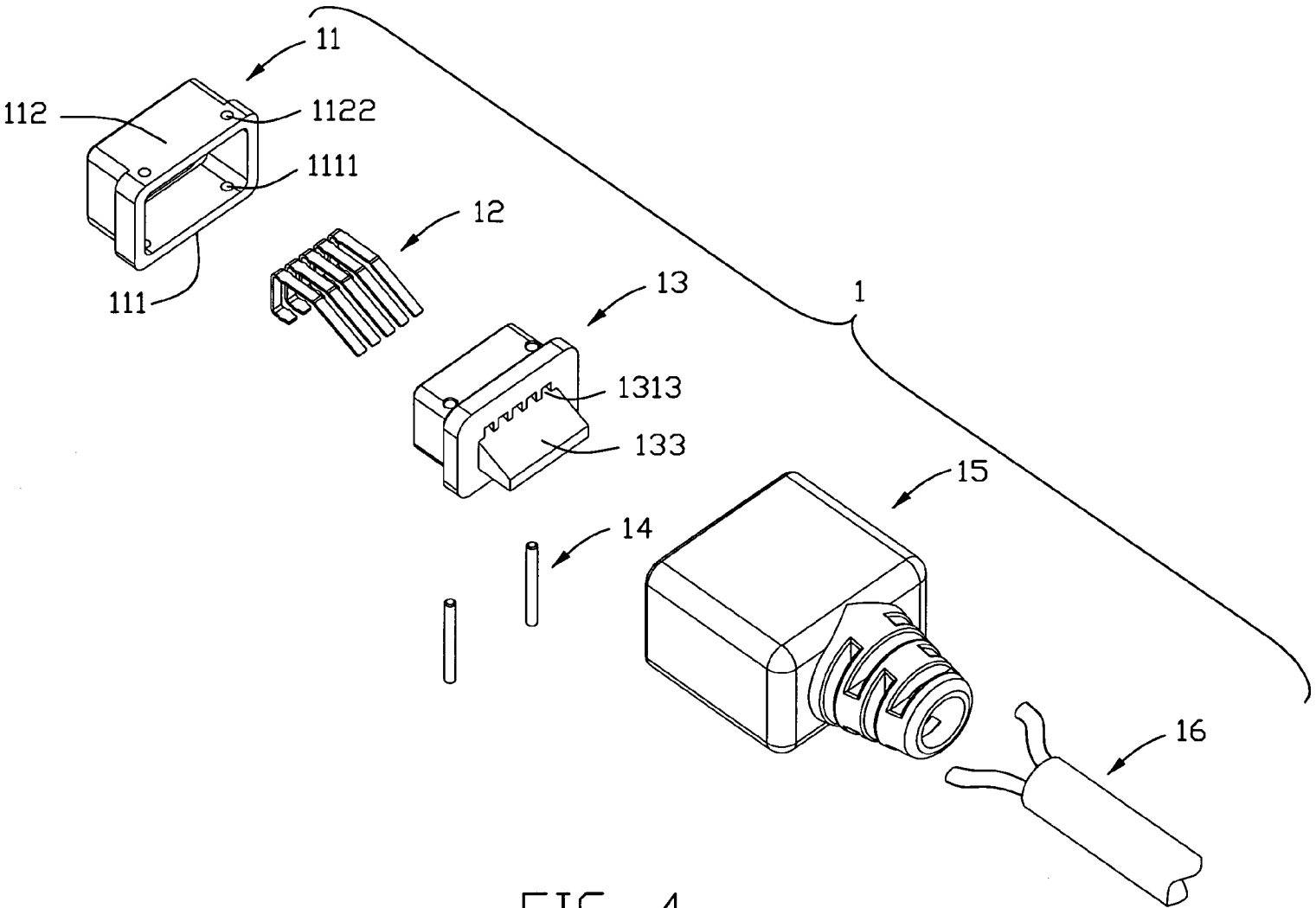
FIG. 4 is a view similar to FIG. 3, but viewed from another aspect.
Figure 5:
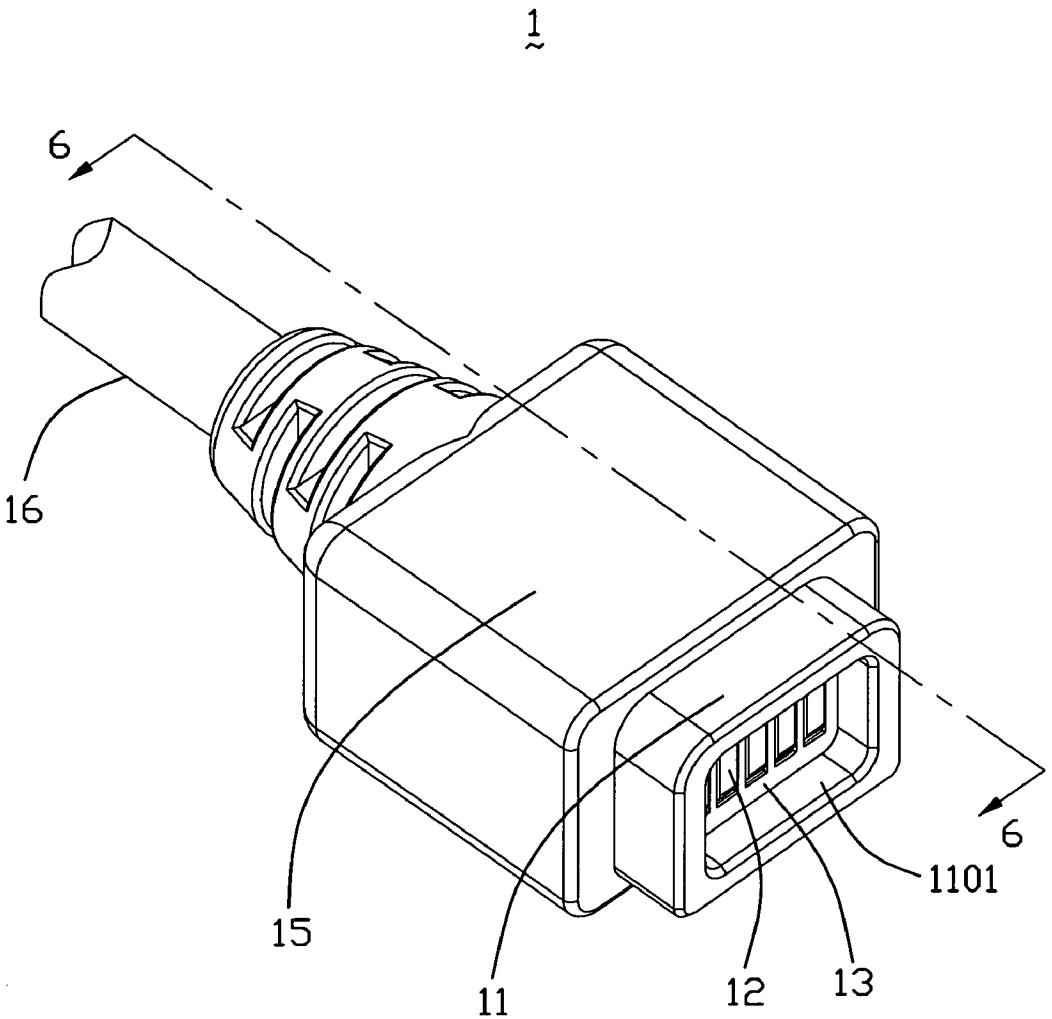
FIG. 5 is an assembled, perspective view of the plug connector shown in FIG. 3.
Figure 6:
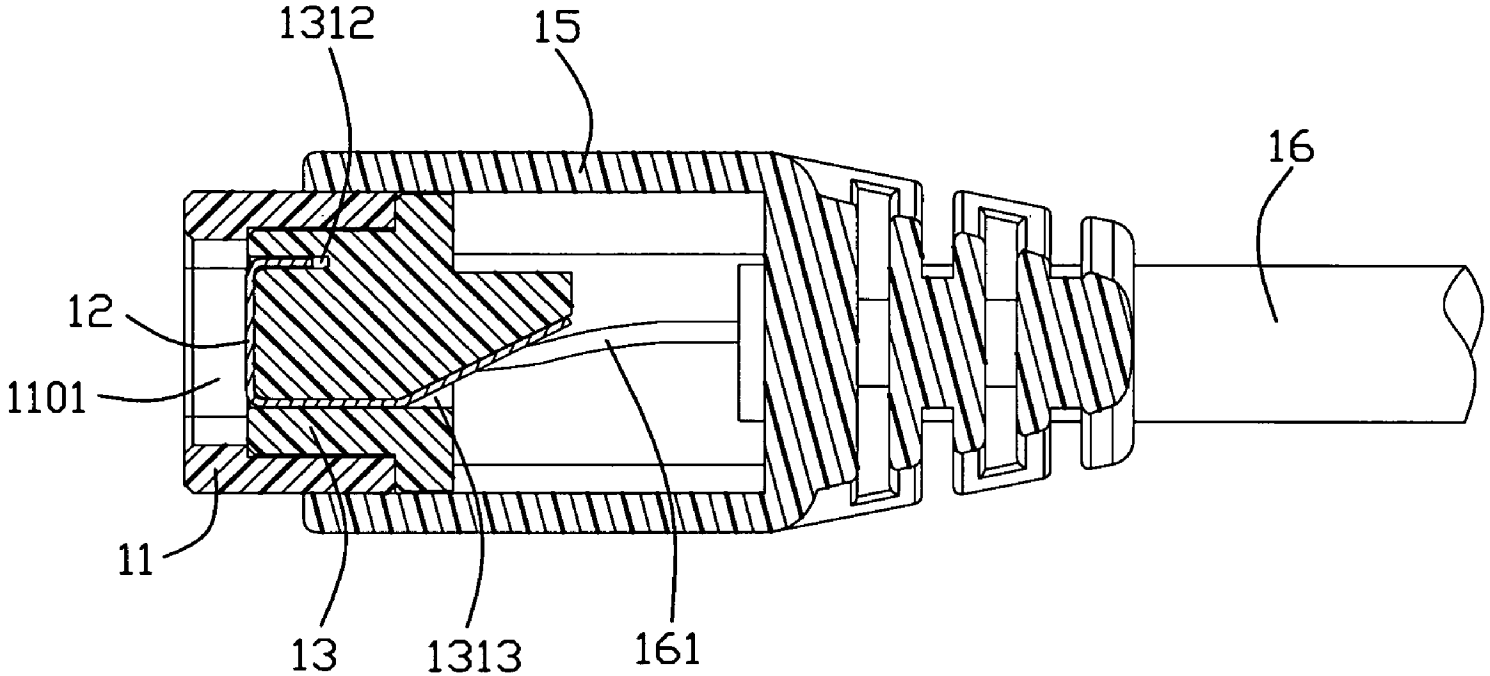
FIG. 6 is a cross-section view taken along line 6-6 of FIG. 5.
Figure 7:
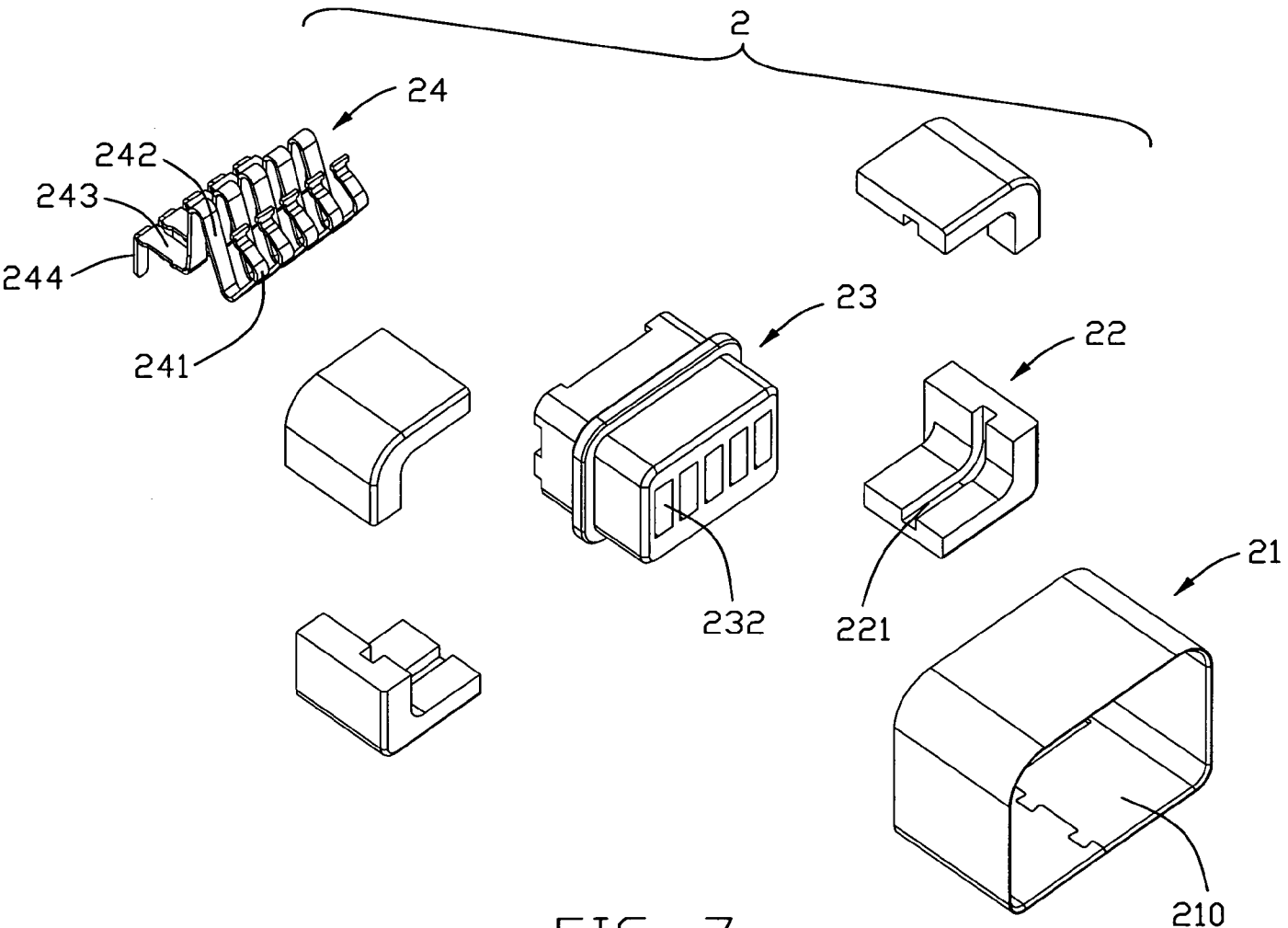
FIG. 7 is an exploded, perspective view of the receptacle connector.
Figure 8:
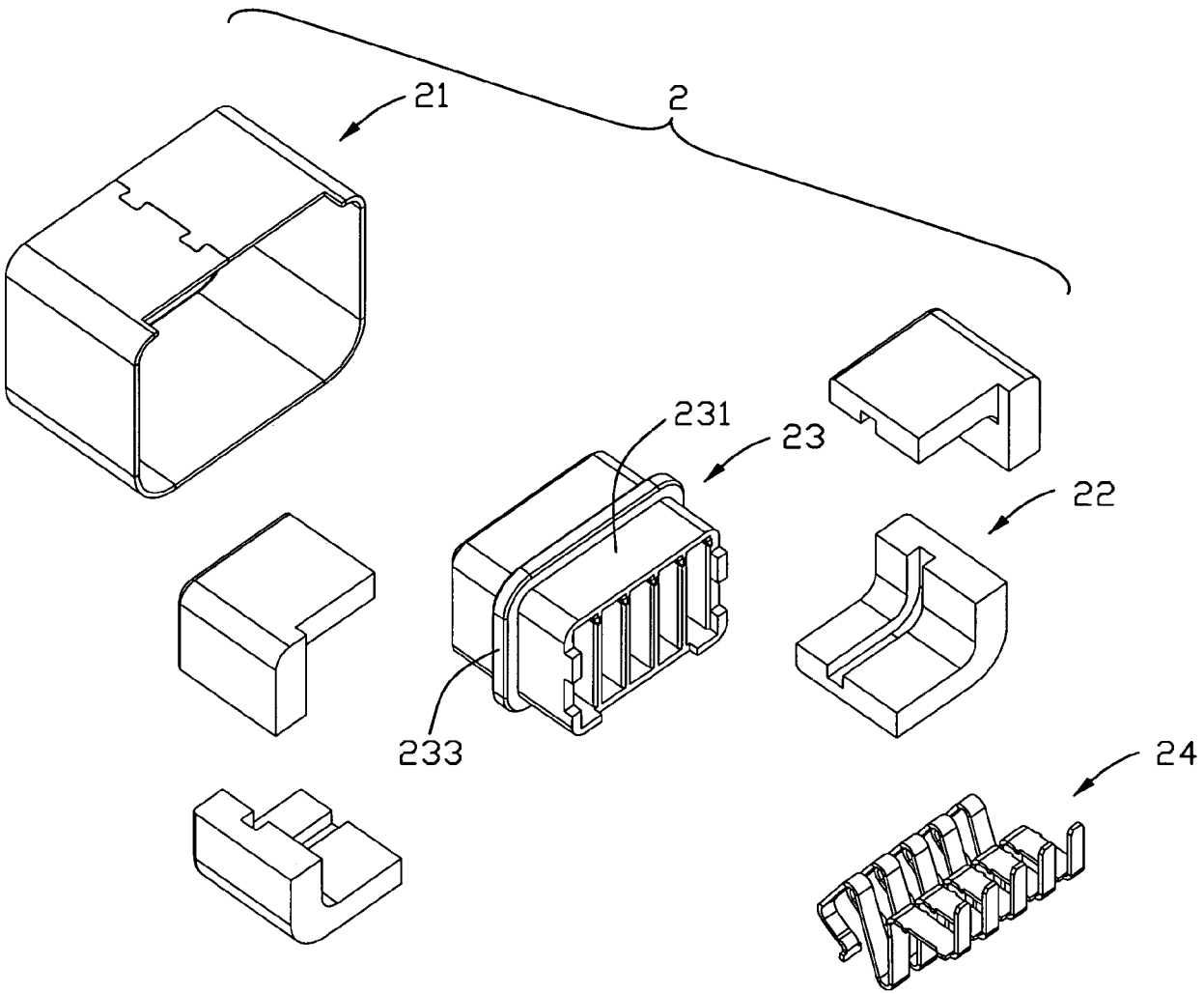
FIG. 8 is a view similar to FIG. 7, but viewed from another aspect.
Figure 9:
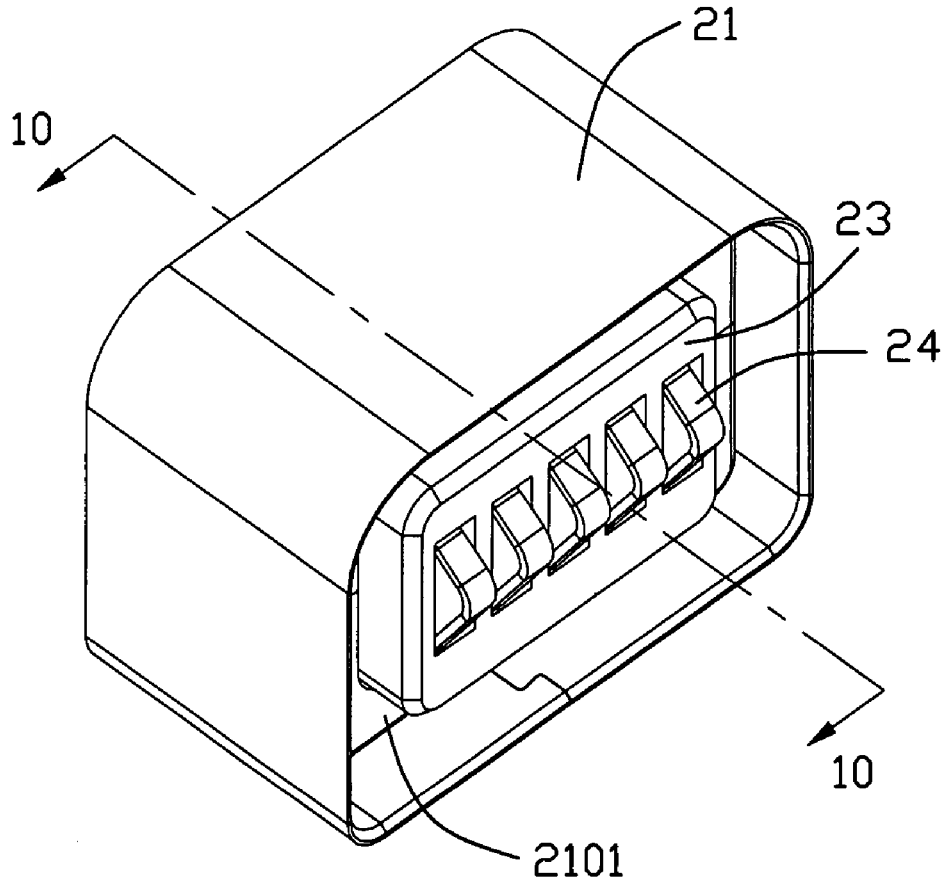
FIG. 9 is an assembled, perspective view of the receptacle connector shown in FIG. 7.
Figure 10:
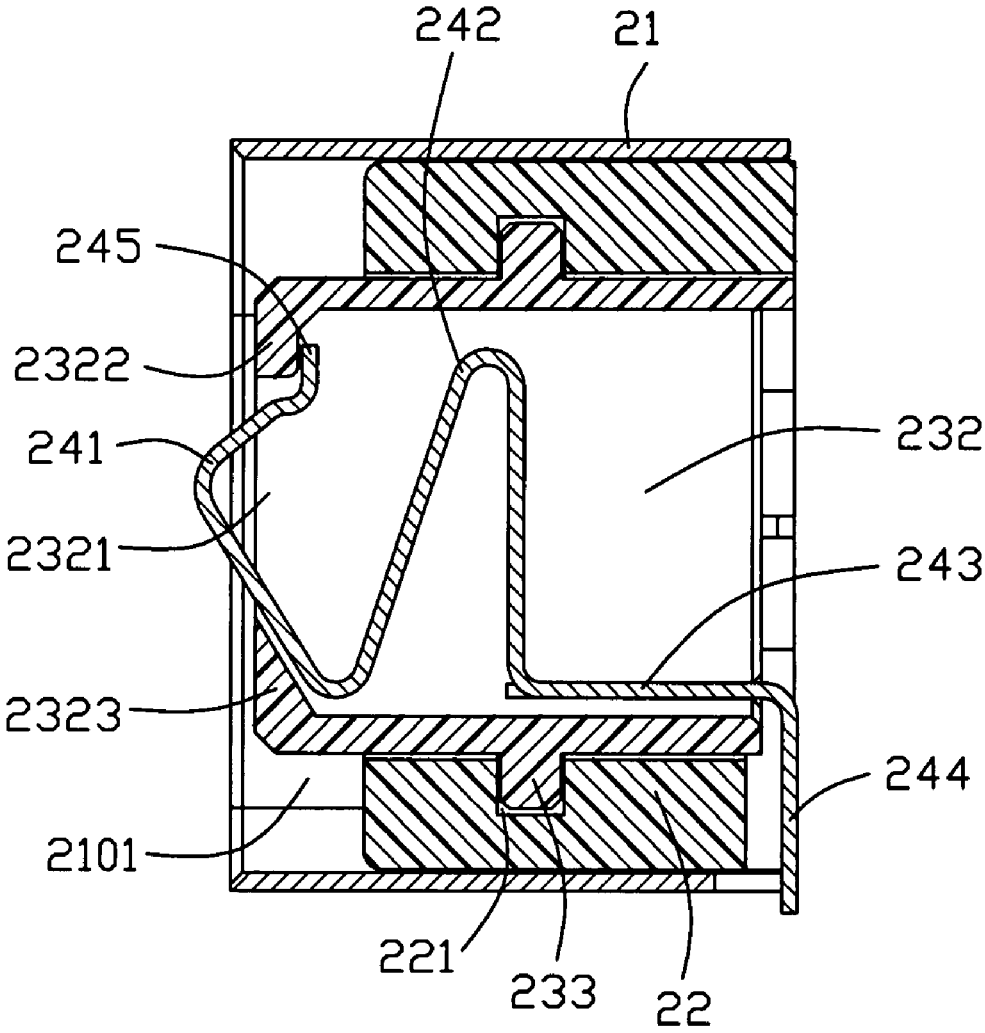
FIG. 10 is a cross-section view taken along line 10-10 of FIG. 9.

Referring to FIGS. 1-2, an electrical connector assembly 100 comprises a plug connector 1 and a receptacle connector 2. The plug connector 1 and the receptacle connector 2 are coupled together via magnetic attraction therebetween.

Referring to FIGS. 3-6, the plug connector 1 comprises an insulated housing 13, a number of terminals 12 received in the insulated housing 13, an attraction member 11 shielding the insulated housing 13, a cable 16 electrically connecting to the terminals 12 and an insulator 15 partially over molded on the magnetic element 11, the cable 16 and the insulated housing 13.

The attraction member 11 is made of permanent magnet or ferromagnetic materials. The attraction member 11 is rectangular-shaped and comprises a top wall 111, a bottom wall 112 and a pair of transversal walls 113, 114 to corporately form a hollow portion 110 therebetween. Each of the pair of the transversal walls 113, 114 further has a vertical protrusion member 115 located at rear section thereof. Both the top wall 111 and the bottom wall 112 define a pair of first through holes 1111, 1122 aligning with each other.

The insulated housing 13 comprises a rectangular-shaped body portion 131, a flange portion 132 encircling along an outside surface of a rear part of the body portion 131 and a wedge-shaped mounting portion 133 extending rearward from back surface of the body portion 131. A front section of the body portion 131 defines five vertical mounting grooves 1311 recessed rearward from forward surface thereof. A first positioning cavity 1312 and a second through positioning cavity 1313 respectively extend interiorly from an upper portion and a lower portion of each mounting groove 1311. A pair of second through holes 1314 passing a top and a bottom surfaces of the body portion 131 are located at lateral sides of the body portion 131 and adjacent to the flange portion 132. The body portion 131 received in the hollow portion 110 of the attraction member 11, a rear surface of the attraction member 11 abuts against a front surface of the flange portion 132, the pair of first through holes 1111, 1122 align with the pair of second through holes 1314 to allow a pair of pin members 14 insert into therein, thus the insulated housing 13 and the attraction member 11 are combined together securely. The insulated housing 13 is interiorly received in the attraction member 11 to form a forward first mating space 1101 between a front section of the attraction member 11 and a front surface of the insulated housing 13.

Each of the terminals 12 is configured to hooked structure and comprises a vertical contact portion 121, a flat upper first retention portion 122 extending rearward from a top end of the vertical contact portion 121, a flat lower second retention portion 123 extending rearward from a lower end of the vertical contact portion 121 and parallel to the first retention portion 122, and a tail portion 124 slantways and upward extending rearward from a rear end of the second retention portion 123. The contact portion 121 is located in corresponding mounting groove 1311, the first retention portion 122 is received in corresponding first retention cavity 1312, while the second retention portion 123 is received in corresponding second retention cavity 1313, and the tail portion 124 extending outward of the back edge of the body portion 131 and supported by the mounting portion 133.

The cable 16 has a number of inner wires 161 soldered to corresponding tail portions 124 of the terminals 12, respectively. The insulator 15 is plastic material and over molded on a forward section of the cable 16, rear sections of the insulated housing 13 and the magnetic member 11.

Referring to FIGS. 7-10, the receptacle connector 2 adapted for mounting on a printed circuit board (not shown) comprises a metal shell 21, four magnetic blocks 22, and an insulative housing 23 and a number of spring contacts 24.

The insulative housing 23 has a rectangular-shaped main portion 231 which further defines a number of through passageways 232 along front-to-back direction therein and a continued flange member 233 surrounding along a middle section thereon. Each of the contacts 24 comprises a V-shaped mating segment 241 with a contacting portion (not numbered) forward extending outside of a front opening 2321 of corresponding passageway 232, a horizontal retention segment 243 inserted molded with and retained in the insulative housing 23, a substantially inverted V-shaped body segment 242 cantilevered in corresponding passageway 232 connecting the mating segment 241 and the retention segment 243, and a tail segment 244 disposed outward of a rear surface of the main portion 231 and further bent downward from a rear end of the retention segment 243. A rectangular first stopper member 2322 is located above and a wedged second member 2323 is beneath a front portion of each of the passageways 232, respectively, and a free end 245 of each of the contacts 24 abuts against the stopper member 2322. The contacts 24 are configured to spring types which can ensure a better electrical connection between the plug connector 1 and the receptacle connector 2.

Each of the magnetic blocks 22 is L-shaped viewed along front-to-back direction and further has a positioning slot 221 located in a middle section of an inside surface thereof. The magnetic blocks 22 are symmetrically arranged outside of the main portion 231 of the insulative housing 23, with the flange portion 233 received in the positioning slots 221 of the magnetic blocks 22. Every two adjacent magnetic blocks 22 attract each other, thus they are combined together. The metal shell 21 is made of a single sheet metal with a receiving space 210. The magnetic blocks 22 are received in the receiving space 210 and bundled by the metal shell 21; therefore they are coupled together much securely. However, it is should be awarded that in another alternative embodiment, two magnetic block or even one magnetic block may be available. While a front section of the insulative housing 23 protrudes forward to exceed front surfaces of the magnetic blocks 22, thus, a forward second mating space 2101 is formed between the metal shell 21 and corresponding front section of the insulated housing 23.

Please referring to FIGS. 1, 2, 6 and 10, when the plug connector 1 mates with the receptacle connector 2, the front section of the insulative housing 23 inserts into the forward first mating space 1101, while the front section of the attraction member 11 is received in the forward second mating space 2101, and such configurations may ensure the plug connector 1 and the receptacle connector 2 mating with other properly. Further more, as a wiping/friction among the spring contacts 24 of the receptacle connector 2 and the terminals 12 of the plug connector 1 to eliminate dust or other materials which may effect reliable electrical connection therebetween, thus the plug connector 1 and the receptacle connector 2 may connect together more better.

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly, comprising:

a plug connector comprising:

an insulated housing defining a number of vertical mounting grooves;

a number of terminals received in the insulated housing, said each of the terminals having a vertical contact portion arranged in corresponding vertical mounting groove;

an attraction member assembled to the insulated housing; and a receptacle connector comprising:

an insulative housing defining a number of passageways along front-to-back direction;

a number of spring type contacts respectively received in the passageways, said each of the contacts having a mating segment forwardly extending out of the passageway;

a magnetic block assembled to the insulative housing of the receptacle connector; and wherein the plug connector and the receptacle connector are securely coupled together via a magnetic attraction between the magnetic member and the attraction member thereof;

wherein the spring contacts of the receptacle connector contact the terminals of the plug connector, respectively.

2. The electrical connector assembly as claimed in claim 1, wherein the plug connector comprises a body portion with a flange portion located at a rear part thereof and a mounting portion extending rearward from a back surface of the body portion.

3. The electrical connector assembly as claimed in claim 1, wherein the attraction member defines a hollow portion therein, wherein the insulated housing is interiorly received in the attraction member to form a forward first mating space between a front section of the attraction member and a front surface of the insulated housing.

4. The electrical connector assembly as claimed in claim 1, wherein the plug connector further comprises a cable with a number of inner wires electrically respectively connecting to the terminals thereof; wherein the plug connector further comprises an insulator partially over molded on the cable, the insulated housing and the magnetic member.

5. The electrical connector assembly as claimed in claim 1, wherein each of the terminals of the plug connector comprises a vertical contact portion arranged in corresponding mounting groove of the insulated housing, wherein the vertical contact portion substantially aligns with a front surface of the insulated housing.

6. The electrical connector assembly as claimed in claim 5, wherein each of the terminals of the plug connector further comprises a first retention portion extending rearward from a top end of the vertical contact portion and a second retention portion extending rearward from a lower end of the vertical contact portion and parallel to the first retention portion, and wherein both the first retention portion and the second retention portion are respectively received in the insulated housing.

7. An electrical connector assembly, comprising:

a plug connector comprising:

an insulated housing;

a number of terminals received in the insulated housing;

an attraction member assembled to the insulated housing; and a receptacle connector comprising:

an insulative housing defining a number of passageways along front-to-back direction;

a number of spring contacts respectively received in the passageways of the insulative housing;

a plurality of magnetic blocks symmetrically arranged around the insulative housing; and wherein the plug connector and the receptacle connector are securely coupled together by a magnetic attraction the magnetic blocks and the attraction member;

wherein the spring contacts of the receptacle connector contact the terminals of the plug connector.

8. The electrical connector assembly as claimed in claim 7, wherein the insulative housing of the receptacle connector further has a first stopper member located above a front portion of each of the passageways abutting against a free end of each of the terminals received in the passageway.

9. The electrical connector assembly as claimed in claim 7, wherein each of the magnetic blocks is configured to L-shaped and has a positioning slot located in an inside surface thereof, and wherein the insulative housing of the receptacle connector has a main portion forming a continued flange member thereon inserting into the positioning slot of the magnetic block.

10. The electrical connector as claimed in claim 7, wherein a front section of the insulative housing of the receptacle connector protrudes forward of the magnetic blocks, wherein the receptacle connector further has a metal shell bundling around the magnetic blocks to form a forward second mating space between the metal shell and the front section of the insulated housing, and wherein the front section of the attraction member of the plug connector is received in the forward second mating space.

11. The electrical connector assembly as claimed in claim 7, wherein each of the spring contacts comprises a substantially inverted V-shaped body segment cantilevered in the passageway and a retention segment connecting to the inverted V-shaped body segment and inserted molded with the insulative housing.

12. The electrical connector assembly as claimed in claim 11, wherein each of the spring contacts further comprises a V-shaped mating segment connecting with the inverted V-shaped body portion and partially extending outside of a front opening the corresponding passageway.

13. The electrical connector assembly as claimed in claim 7, wherein the insulated housing of the plug connector further comprises a body portion and a mounting portion extending rearward from a back surface of the body portion; wherein a front section of the body portion defines a plurality of mounting grooves recessed rearward from forward surface thereof, a plurality of first positioning cavities and second positioning cavities respectively extending interiorly from upper portions and lower portions of the mounting grooves.

14. The electrical connector assembly as claimed in claim 13, wherein each of the terminals of the plug connector is configured to hooked structure which comprises a mating portion received in corresponding mounting groove of the insulated housing, a first and a second a first retention portion extending rearward from a top end of the vertical contact portion and received in corresponding first and second positioning cavities, respectively.

15. An electrical connector assembly comprising:

a first connector including:

a first insulative housing enclosing a plurality of first contacts therein;

a first mating region around with said first contacts exposed;

a second connector mating with the first connector in a mating direction and including:

a second insulative housing enclosing a plurality of second contacts;

a second mating region around which said second contacts are exposed so as to mate with the first mating region in said mating direction; and a set of kits including two parts, of which one part substantially fully surrounds the first mating region, and the other part substantially fully surrounds the second mating region; wherein at least one of said parts is magnetic to attract the other in said mating direction;

wherein said first mating region and said second mating region are essentially mated in a head-to-head manner in said mating direction without overlapping in a transverse direction perpendicular to said mating direction.

* * * * *

UNITED STATES PATENT AND TRADEMARK OFFICE

CERTIFICATE OF CORRECTION

PATENT NO. : 7,566,224 B2
APPLICATION NO. : 11/982636
DATED : July 28, 2009
INVENTOR(S) : Jerry Wu It is certified that error appears in the above-identified patent and that said Letters Patent is hereby corrected as shown below:

On the Title page, in field (56), under "U.S. Patent Documents", in column 2, line 7, delete "Awad et al." and insert -- Awad --, therefor.

In column 5, line 28, in Claim 7, delete "attraction" and insert -- attraction, --, therefor.

Signed and Sealed this
First Day of November, 2011

David J. Kappos
*Director of the United States Patent and Trademark Office*